US008676111B2

(12) United States Patent
Aoi

(10) Patent No.: US 8,676,111 B2
(45) Date of Patent: Mar. 18, 2014

(54) IMAGE FORMING APPARATUS AND CONTROL METHOD FOR THE SAME

(75) Inventor: Yosuke Aoi, Aichi (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 430 days.

(21) Appl. No.: 13/073,422

(22) Filed: Mar. 28, 2011

(65) Prior Publication Data

US 2011/0318078 A1 Dec. 29, 2011

(30) Foreign Application Priority Data

Jun. 24, 2010 (JP) ..... 2010-144310

(51) Int. Cl.
*G03G 15/00* (2006.01)

(52) U.S. Cl.
USPC ..... 399/397; 399/364; 399/401

(58) Field of Classification Search
USPC ..... 399/364, 401, 397
See application file for complete search history.

(56) References Cited

U.S. PATENT DOCUMENTS

| | | | | |
|---|---|---|---|---|
| 2004/0253009 | A1* | 12/2004 | Kitamura | 399/13 |
| 2005/0244203 | A1* | 11/2005 | Kamiyama | 399/341 |
| 2009/0035032 | A1* | 2/2009 | Etoh | 399/322 |
| 2010/0244365 | A1* | 9/2010 | Tomura et al. | 271/18 |

FOREIGN PATENT DOCUMENTS

| | | | |
|---|---|---|---|
| JP | 2002214860 | A | 7/2002 |
| JP | 2004-333930 | | 11/2004 |
| JP | 2007055717 | A | 3/2007 |
| JP | 2009282105 | A | 12/2009 |
| JP | 2010-048961 | | 3/2010 |

OTHER PUBLICATIONS

Notice of Allowance for Japanese patent application No. 2010-144310 mailed May 1, 2012.

* cited by examiner

*Primary Examiner* — Matthew G Marini
*Assistant Examiner* — Allister Primo
(74) *Attorney, Agent, or Firm* — Banner & Witcoff, Ltd.

(57) ABSTRACT

An image forming apparatus is provided, which includes a fixing unit, a cooling roller disposed downstream relative to the fixing unit in a sheet feeding direction, an ejection roller disposed downstream relative to the cooling roller in the sheet feeding direction, a driving unit rotating the cooling roller and the ejection roller normally or reversely, and a controller including a determining unit determining whether a detected temperature is higher than a predetermined temperature, the controller switching between a first mode to, after a sheet passes through the cooling roller, control the driving unit to reversely rotate the cooling roller and the ejection roller being rotating normally and a second mode to, in a state where the cooling roller is nipping the sheet, control the driving unit to reversely rotate the cooling roller and the ejection roller being rotating normally, based on the determination of the determining unit.

16 Claims, 8 Drawing Sheets

IMAGE FORMING APPARATUS AND CONTROL METHOD FOR THE SAME

CROSS-REFERENCE TO RELATED APPLICATION

This application claims priority under 35 U.S.C. §119 from Japanese Patent Application No. 2010-144310 filed on Jun. 24, 2010. The entire subject matter of the application is incorporated herein by reference.

BACKGROUND

1. Technical Field

The following description relates to one or more techniques for controlling an electrophotographic image forming apparatus configured to perform double-side printing to print an image on each side of a sheet.

2. Related Art

So far, an electrophotographic image forming apparatus has been known, which performs double-side printing by switching back a sheet with an image thermally fixed on a first side thereof using an ejection roller and again feeding the sheet to an image forming unit, before forming an image on a second side of the sheet.

In the double-side printing performed by such an image forming apparatus, water contained in the sheet is evaporated by heat generated by a fixing unit during image formation on the first side. Therefore, it might lead to a drying mark (a drying spot) that has a negative influence on quality of the image formed on the second side.

In order to resolve such a negative influence on quality of the image formed on the second side, a technique using a cooling roller has been proposed, which cooling roller is configured to contact the sheet which has passed through the fixing unit and to evenly cool the whole sheet.

SUMMARY

A commercially available image forming apparatus is used in a wide range of temperatures in a wide variety of areas or environments. Hence, depending on a situation (for example, when the image forming apparatus is used in a low-temperature environment), the operation of cooling the sheet may be unnecessary.

However, when the sheet is always cooled by the cooling roller as executed in the known technique, the sheet might be excessively cooled and uselessly fed in some situations. Accordingly, the sheet is required to be fed depending on a situation.

Aspects of the present invention are advantageous to provide one or more improved techniques for controlling an image forming apparatus capable of double-side printing which techniques make it possible to feed a sheet depending on a situation.

According to aspects of the present invention, an image forming apparatus is provided, which is configured to print an image on each side of a sheet by switching back the sheet. The image forming apparatus includes an image forming unit configured to form a developer image on the sheet, a fixing unit configured to fix the developer image formed on the sheet by the image forming unit, a cooling roller disposed downstream relative to the fixing unit in a sheet feeding direction, the cooling roller being configured to cool the sheet on which the developer image is fixed by the fixing unit, an ejection roller disposed downstream relative to the cooling roller in the sheet feeding direction, the ejection roller being configured to eject the sheet onto a catch tray, a driving unit configured to rotate the cooling roller and the ejection roller normally or reversely, a temperature sensor configured to detect a temperature of the image forming apparatus, and a controller including a determining unit configured to make a determination as to whether the temperature detected by the temperature sensor is higher than a predetermined temperature, the controller being configured to switch a control mode between a first mode and a second mode based on the determination made by the determining unit as to whether the detected temperature is higher than the predetermined temperature. In the first mode, after the sheet passes through the cooling roller, the controller controls the driving unit to reversely rotate the cooling roller and the ejection roller being rotating normally. In the second mode, in a state where the cooling roller is nipping the sheet, the controller controls the driving unit to reversely rotate the cooling roller and the ejection roller being rotating normally.

According to aspects of the present invention, further provided is a control method for controlling an image forming apparatus configured to print an image on each side of a sheet by switching back the sheet, the image forming apparatus including an image forming unit configured to form a developer image on the sheet, a fixing unit configured to fix the developer image formed on the sheet by the image forming unit, a cooling roller disposed downstream relative to the fixing unit in a sheet feeding direction, the cooling roller being configured to cool the sheet on which the developer image is fixed by the fixing unit, and an ejection roller disposed downstream relative to the cooling roller in the sheet feeding direction, the ejection roller being configured to eject the sheet onto a catch tray, the control method including the steps of detecting a temperature of the image forming apparatus, making a determination as to whether the detected temperature is higher than a predetermined temperature, and switching a control mode between a first mode and a second mode based on the determination as to whether the detected temperature is higher than the predetermined temperature. In the first mode, after the sheet passes through the cooling roller, the cooling roller and the ejection roller being rotating normally are controlled to reversely rotate. In the second mode, in a state where the cooling roller is nipping the sheet, the cooling roller and the ejection roller being rotating normally are controlled to reversely rotate.

BRIEF DESCRIPTION OF THE ACCOMPANYING DRAWINGS

DETAILED DESCRIPTION

It is noted that various connections are set forth between elements in the following description. It is noted that these connections in general and, unless specified otherwise, may be direct or indirect and that this specification is not intended to be limiting in this respect. Aspects of the invention may be implemented in computer software as programs storable on computer-readable media including but not limited to RAMs, ROMs, flash memories, EEPROMs, CD-media, DVD-media, temporary storage, hard disk drives, floppy drives, permanent storage, and the like.

Hereinafter, an embodiment according to aspects of the present invention will be described with reference to the accompany drawings. In the embodiment, a direct tandem type color printer, which includes a plurality of photoconductive drums aligned along a direction perpendicular to an axial direction of the photoconductive drums, is exemplified as an electrophotographic image forming apparatus. It is noted that a front-to-rear direction, a left-to-right direction, and an up-to-down direction of a color printer 1 are defined as indicated in FIG. 1.

<Configuration of Printer>

Figure 1:
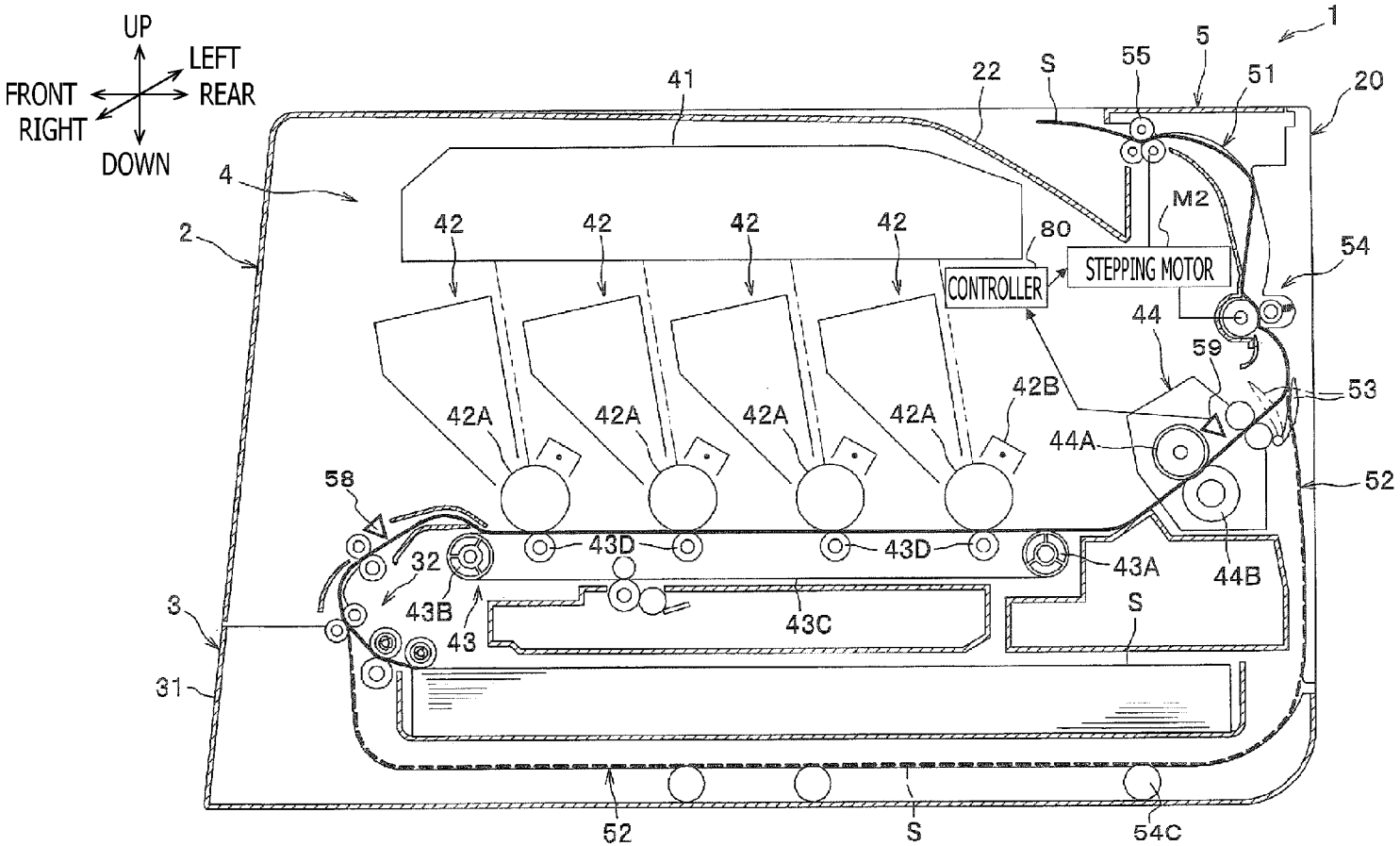
FIG. 1 is a cross-sectional side view schematically showing a configuration of a color printer in an embodiment according to one or more aspects of the present invention.

As shown in FIG. 1, the color printer 1 is configured to perform image formation (printing) on both sides of a sheet S. The color printer 1 includes a main body casing 2, and further includes a sheet feeding unit 3, an image forming unit 4, and an ejection-switchback unit 5 inside the main body casing 2.

The color printer 1 further includes a cover 20 disposed at a rear side of the main body casing 2. The cover 20 forms one of four side walls in the front-to-rear direction and the left-to-right direction, i.e., a rear wall. It is noted that the cover 20 may be supported rotatably around a rotation axis (not shown) so as to be openable and closable.

The sheet feeding unit 3 is disposed at a lower side of the main body casing 2. The sheet feeding unit 3 includes a feed tray 31, a sheet feeding mechanism 32, and a feed sensor 58.

The feed tray 31 is configured such that sheets S are placed thereon. The sheets S placed on the feed tray 31 are fed to the image forming unit 4 by the sheet feeding mechanism 32.

The feed sensor 58 is used for timing control for the sheet S to be fed by the sheet feeding mechanism and an image forming operation in which the image forming unit 4 performs image formation in a timely fashion in response to the sheet S fed by the sheet feeding mechanism 32.

The image forming unit 4 includes an exposure unit 41, four process units 42, a transfer unit 43, and a fixing unit 44.

The exposure unit 41 is disposed at an upper side inside the main body casing 2. The exposure unit 41 includes various elements (not shown) such as a laser light source, a polygon mirror, a lens, and a mirror. A laser beam emitted by the laser light source based on image data is deflected by the polygon mirror, reflected by the mirror, transmitted through the lens, and scanned at a high speed on a surface of a corresponding one of four photoconductive drums 42A such that an electrostatic latent image is formed on the photoconductive drum 42A. It is noted that instead of the laser light source, a known light source, such as an LED light source, used for an electrophotographic printer may be utilized.

Each process unit 42 is configured to develop the electrostatic latent image formed on a corresponding one of the photoconductive drums 42A. The process units 41 are arranged side by side along the front-to-rear direction, and disposed between the feed tray 31 and the exposure unit 41 in the up-to-down direction. Each process unit 41 includes a photoconductive drum 42A, an electrification device 42B, a development roller (not shown), a supply roller (not shown), and a toner container (not shown). The process units 42 are configured substantially in the same manner, except for respective different colors of toner stored in the toner containers thereof.

The transfer unit 43 is configured to transfer each image developed by the process units 42 onto the sheet S. The transfer unit 43 is disposed between the feed tray 31 and the process units 42. The transfer unit 43 includes an endless conveying belt 43C wound around the pair of a driving roller 43A and a driven roller 43B, and four transfer rollers 43D. The conveying belt 43C is configured such that an up-facing outer surface thereof contacts each photoconductive drum 42A. In a space surrounded by the conveying belt 43C, each transfer roller 43D is disposed, so as to face a corresponding one of the photoconductive drums 42A across the conveying belt 43C.

The fixing unit 44 is configured to thermally fix a toner image transferred onto the sheet S. The fixing unit 44 is disposed behind the process units 42. The fixing unit 44 includes a heating roller 44A and a pressing roller 44B that is disposed to face the heating roller 44A and configured to press the sheet S against the heating roller 44A.

In the image forming unit 4, when the surface of the photoconductive drum 42A, after evenly charged by the electrification device 42B, is exposed to the laser beam (see chained lines in FIG. 1) emitted by the exposure unit 41, the electrostatic latent image based on the image data is formed on the photoconductive drum 42A. Then, when the toner stored in the toner container is supplied to the electrostatic latent image on the photoconductive drum 42A via the supply roller and the development roller, the electrostatic latent image is rendered visible such that the toner image is formed on the photoconductive drum 42A.

After that, while the sheet S (supplied to the image forming unit 4 from the sheet feeding unit 3) is conveyed on the conveying belt 43C between the photoconductive drums 42A and the transfer rollers 43D, the toner images formed on the photoconductive drums 42A are sequentially transferred and superimposed on the sheet S. Then, when the sheet S is conveyed between the heating roller 44A and the pressing roller 44B, the toner images transferred onto the sheet S are thermally fixed such that an intended image is formed on the sheet S.

There is a sheet sensor 59 disposed downstream relative to the fixing unit 44 in a sheet feeding direction. The sheet sensor 59 is configured to detect a leading end and a trailing end of the sheet S, and used for timing control for the sheet S to be conveyed in a switchback manner and detection of a paper jam in the fixing unit 44.

The sheet S with the toner images thermally fixed by the fixing unit 44 is fed toward a catch tray 22 by the ejection-switchback unit 5. In the case of single-side printing, the sheet S is ejected onto the catch tray 22. Meanwhile, in the case of double-side printing, the sheet S is switched back by the ejection-switchback unit 5 and again conveyed to the image forming unit 4 via a reverse path 52, in order to perform printing on the second side of the sheet S.

Subsequently, an explanation will be provided about a configuration for controlling the color printer 1 in the embodiment.

Figure 2:
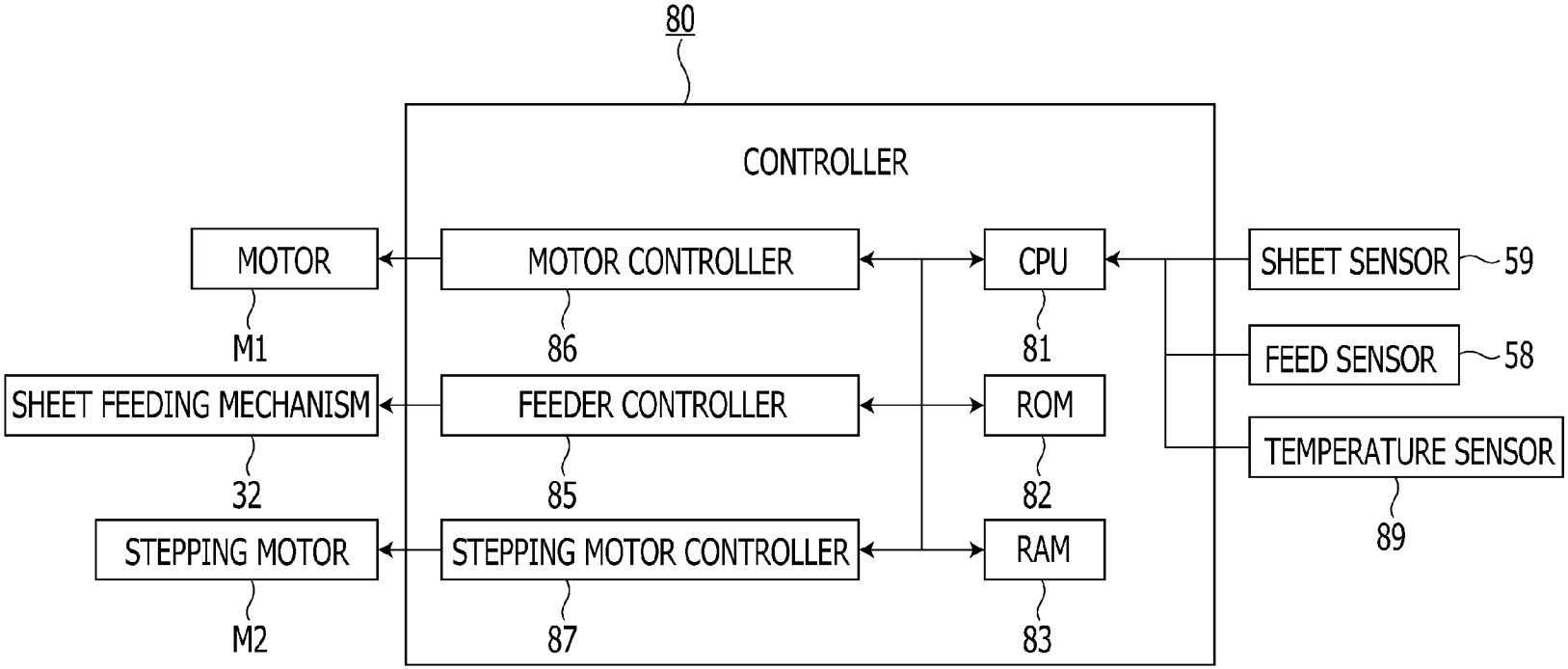
FIG. 2 is a block diagram showing a configuration of a control system for the color printer in the embodiment according to one or more aspects of the present invention.

As shown in FIG. 2, the color printer 1 includes a motor M1 for driving the sheet feeding mechanism 32 and the photoconductive drums 42A, a stepping motor M2 for driving cooling rollers 54 and ejection rollers 55, a feed sensor 59, the sheet sensor 59, a temperature sensor 89 disposed inside the main body casing 2 to detect a temperature in the color printer 1, and a controller 80 configured to take overall control of operations in the color printer 1.

The controller 80 includes a CPU 81, a ROM 82, a RAM 83, a feeder controller 85, a motor controller 86, and a stepping motor controller 87, and takes control of the whole operations in the color printer 1.

The CPU 81 is a central processing unit for controlling the color printer 1, and includes a timer therein. The CPU 81 reads out and executes various control programs stored on the ROM 82, and sends control signals to the feeder controller 85, the motor controller 86, and the stepping motor controller 87.

The ROM 82 is a storage device that stores thereon various control programs and data tables required for controlling the color printer 1.

The RAM 83 is a storage device configured to temporarily store calculation results provided by the CPU 81.

The feeder controller 85 issues a driving command to the sheet feeding mechanism 35 based on the signals from the CPU 81 and controls operations of the sheet feeding mechanism 32.

The motor controller 86 controls the motor M1 to be driven based on a control signal from the CPU 81.

The stepping motor controller 87 controls the stepping motor M2 to be driven based on a control signal from the CPU 81.

The stepping motor M2 is linked with the ejection rollers 55 and the cooling rollers 54 via a gear mechanism (not shown), and rotated normally or reversely in accordance with a control signal from the CPU 81. When the stepping motor M2 is controlled to rotate normally or reversely, a driving roller 54A is rotated normally or reversely such that the sheet S nipped between the cooling rollers 54 is fed toward the catch tray 22 or switched back. In the same manner, when the stepping motor M2 is controlled to rotate normally or reversely, a driving one of the ejections rollers 55 is rotated normally or reversely such that the sheet S nipped between the ejection rollers 55 is fed toward the catch tray 22 or switched back.

The controller 80 is connected with the feed sensor 58, the sheet sensor 59, and the temperature sensor 89. Accordingly, the CPU 81 takes feeding control of the sheet S in response to detection results of the feed sensor 58, the sheet sensor 59, and the temperature sensor 89.

<Ejection-Switchback Unit>

As illustrated in FIG. 1, the ejection-switchback unit 5 includes a feeding path 51, the reverse path 52, a flapper 53 swingable back and forth (in the front-to-rear direction), the cooling rollers 54, and the ejections rollers 55.

The feeding path 51 is configured to guide the sheet S fed by the image forming unit 4 (the fixing unit 44) toward a higher position than the fixing unit 44 and guide the sheet S down (toward the reverse path 52) in double-side printing. The feeding path 51 extends upward from the vicinity of front of the flapper 53 swinging back (see a solid line in FIG. 1) and thereafter curves forward.

The reverse path 52 is configured to guide the sheet S, switched back by the cooling rollers 54 and the ejection rollers 55 in double-side printing, again toward the image forming unit 4. The reverse path 52 extends downward from the vicinity of the rear of the flapper 53 swinging forth (see a dashed line in FIG. 1) and thereafter curves up toward the sheet feeding mechanism 32.

The flapper 53 is configured to guide the switched-back sheet toward the reverse path 52. The flapper 53 is disposed downstream relative to the fixing unit 44 in the sheet feeding direction. The flapper 53 is configured such that an upper end thereof is swingable back and forth around a swing axis placed at a lower end thereof. The flapper 53 is always urged forward by an elastic member (not shown). Thereby, the flapper 53 is pushed rearward by the sheet S fed by the fixing unit 44, and guides the sheet S toward the cooling roller 54. When the sheet S is switched back, the flapper 53 is inclined forward by the elastic member as indicated by the dashed line in FIG. 1. Thus, a rear surface of the flatter 53 serves as a guide for guiding the sheet to the reverse path 52.

Figure 3:
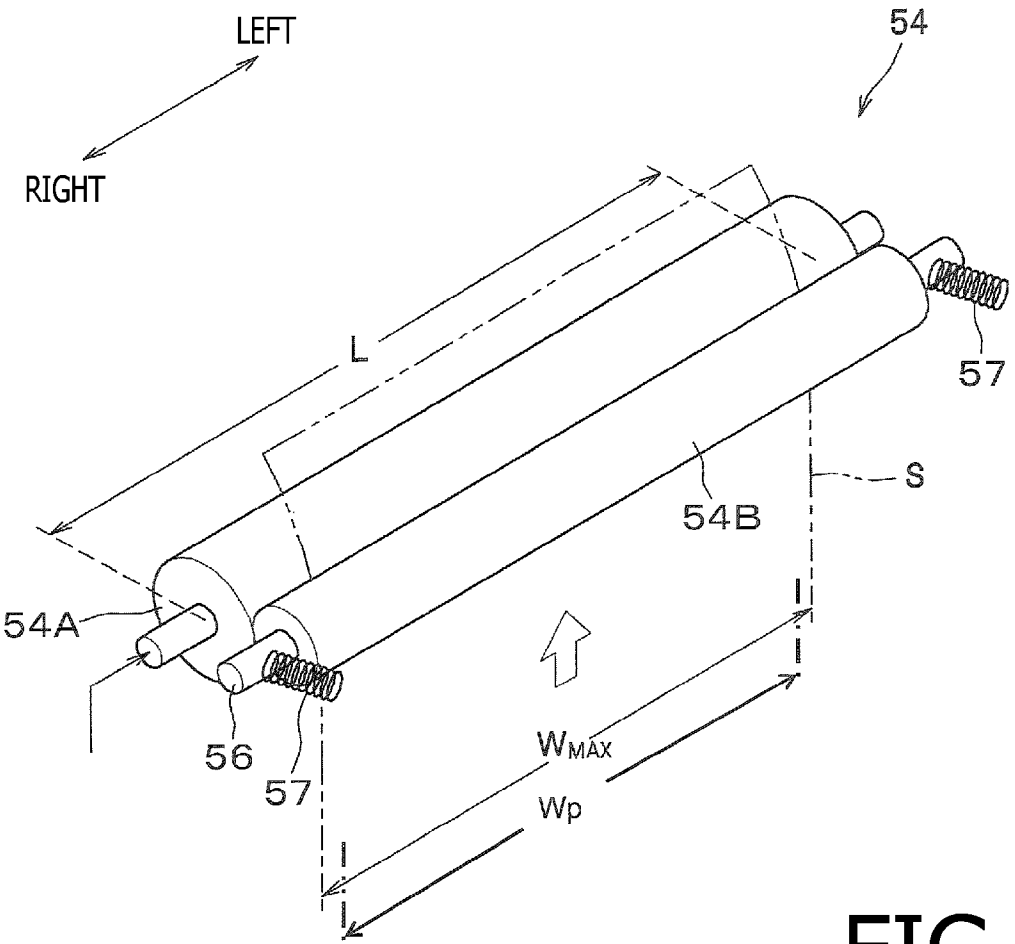
FIG. 3 is a perspective view schematically showing a configuration of cooling rollers for the color printer in the embodiment according to one or more aspects of the present invention.

The cooling rollers 54 are disposed downstream relative the fixing unit 44 and the flapper 53 in the sheet feeding direction, and linked with the stepping motor M2 via a gear mechanism (not shown). The cooling rollers 54 are rubber rollers configured to rotate normally and reversely depending on a rotational direction of the stepping motor M2. When rotated normally, the cooling rollers 54 convey, toward the catch tray 22, the sheet S fed by the fixing unit 44. When rotated reversely in double-side printing, the cooling rollers 54 switch back the sheet S nipped thereby and convey the sheet S toward the reverse path 52. The cooling rollers 54 include the driving roller 54A and a driven roller 54B disposed to face the driving roller 54A, as depicted in FIG. 3. The driven roller 54B is urged against the driving roller 54A by springs 57 disposed near both ends of the rotational shaft 56 in an axis line direction of the rotational shaft 56. A width L of the cooling rollers 54 in the axis line direction is set longer than a width Wp of a printable area of the largest-sized one (sheet S) of printable sheets for the color printer 1. Therefore, the cooling roller 54 can contact the whole of the width Wp. In the embodiment, the width L of the cooling rollers 54 is set longer than the maximum width Wmax of the printable sheets. However, as described above, the width L of the cooling rollers 54 has only to be set longer than the width Wp of the printable area of the largest-sized one of the printable sheets for the color printer 1.

Thereby, immediately after heated by the fixing unit 44, the sheet S is cooled promptly at least within the printable area. Since the sheet S is cooled by the cooling rollers 54, it is possible to prevent the sheet S from being curled by heat. Further, it becomes hard for water contained in the sheet S to evaporate unevenly within the printable area. Consequently, it is possible to prevent a paper jam that might be caused by the sheet S curled in double-side printing and an undesired quality of image that might be caused by a failure in transferring the toner images resulting from unevenness of the water amount within the printable area of the sheet S.

The ejection rollers 55 are disposed in a position downstream relative to the cooling rollers 54 and just upstream relative to the catch tray 22 in the sheet feeding direction. The ejection rollers 55 are linked with the stepping motor M2 so as to be driven in conjunction with the stepping motor M2. Namely, the ejections rollers 55 are configured to rotate normally and reversely, so as to eject or switch back the sheet S nipped thereby depending on a rotational direction thereof. Specifically, when rotating normally, the ejection rollers 55 ejects the sheet S fed by the cooling rollers 54, onto the catch tray 22. When rotating reversely, the ejection rollers 55 draws and switches back the sheet S nipped thereby into the main body casing 2 and conveys the sheet S toward the cooling rollers 54.

In the ejection-switchback unit 5, in single-side printing or after completion of double-side printing, the sheet S fed by the image forming unit 4 (the fixing unit 44) is conveyed from the cooling rollers 54 to the ejections rollers 55 on the feeding path 51 in response to normal rotation of the cooling rollers 54, and further ejected onto the catch tray 22 in response to normal rotation of the ejection rollers 55.

Meanwhile, in double-side printing, the sheet S is switched back by the cooling rollers 54 and the ejection rollers 55. The switchback operation differs depending on the detection result of the temperature sensor 89. More specifically, the switchback operation is performed in one of two modes, which is set depending on whether a temperature T detected by the temperature sensor 89 is higher than a predetermined temperature T1. For instance, the predetermined temperature T1 may be set to 7 degrees Celsius, which is a critical temperature between desired temperatures at which the stepping motor M2 normally operates and undesired temperatures at which the stepping motor M2 is likely to abnormally operate due to an escalated viscosity of grease used for the stepping motor M2. When the temperature in the color printer 1 is lower than 7 degrees Celsius, the stepping motor M2 might cause so-called "loss of synchronism," as the torque of the stepping motor M2 becomes lower than a required driving torque that rises in response to the cooling rollers 54 (driven by the stepping motor M2) nipping the sheet S switched back by the ejection rollers 55. Accordingly, the color printer 1 performs sheet feeding in one of different modes to be set depending on the temperature T inside the color printer 1 (hereinafter referred to as the "in-device temperature T"). Hereinafter, an explanation will be provided about a sheet feeding method in each mode, with reference to FIGS. 4 to 8.

It is noted that the predetermined temperature T1 is not limited to the critical temperature determined based on whether the "loss of synchronism" is caused in the stepping motor M2. For example, a different temperature may be set as needed depending on a situation, such as a critical temperature at a higher temperature than which the stepping motor M2 might not normally operate.

(1) First Mode (Double-Side Printing and the Temperature T>T1)

Figure 4:
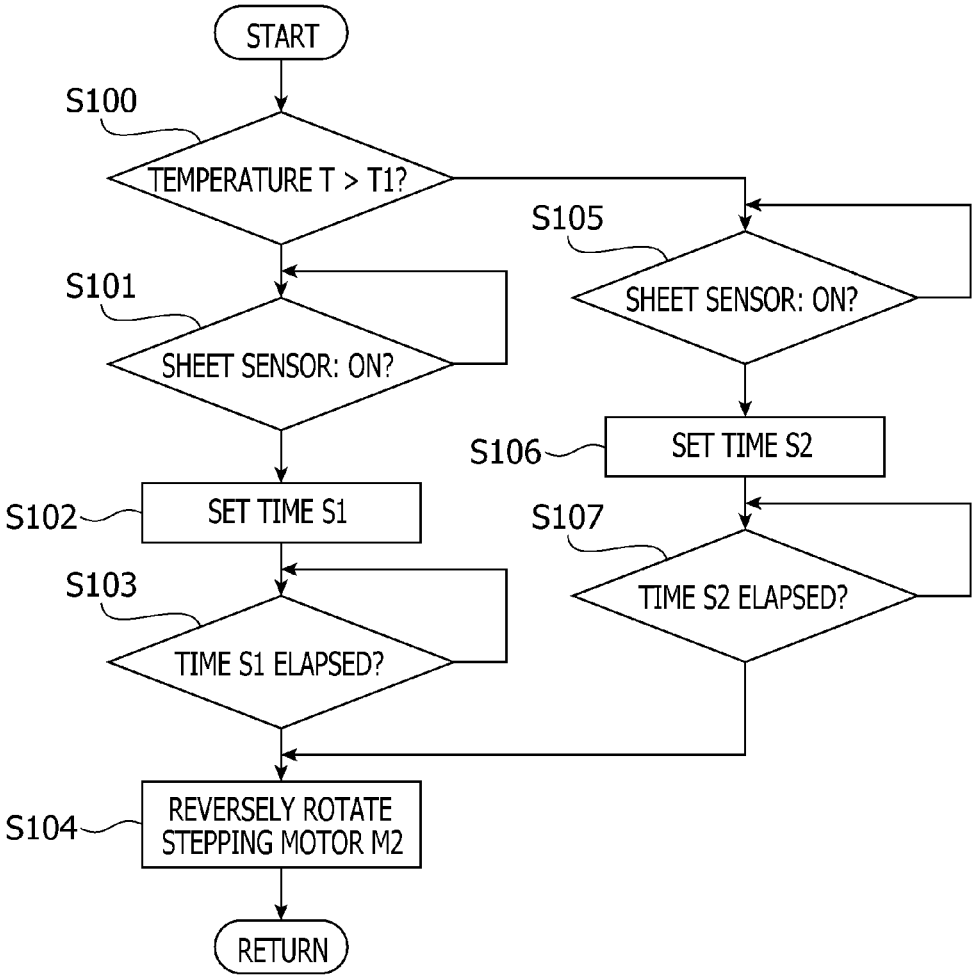
FIG. 4 is a flowchart showing a control procedure to be taken by a controller of the color printer in double-side printing in the embodiment according to one or more aspects of the present invention.

FIG. 4 is a flowchart showing a procedure of switchback control to be taken by the controller 80 when the double-side printing is set to be performed. It is noted that the procedure shown in FIG. 4 corresponds to a sub routine to be executed in a main routine (not shown).

As shown in FIG. 4, when the double-side printing is set to be performed, the CPU 81 determines in S100 whether the in-device temperature T is higher than the predetermined temperature T1, based on the detection result of the temperature sensor 89.

When determining that the in-device temperature T is higher than the predetermined temperature T1 (S100: Yes), the CPU 81 waits in a standby state for a trailing end SE (see FIG. 5) of the sheet S to pass through the sheet sensor 59 (S101: No). When determining that the trailing end SE of the sheet S has passed through the sheet sensor 59 (S101: Yes), the CPU 81 sets, onto the RAM 83, a predetermined time S1 stored on the ROM 82 (S102). Further, the CPU 81 sets the built-in timer and controls the stepping motor M2 to keep rotating normally until the predetermined time S1 elapses (S103: No).

Figure 6:
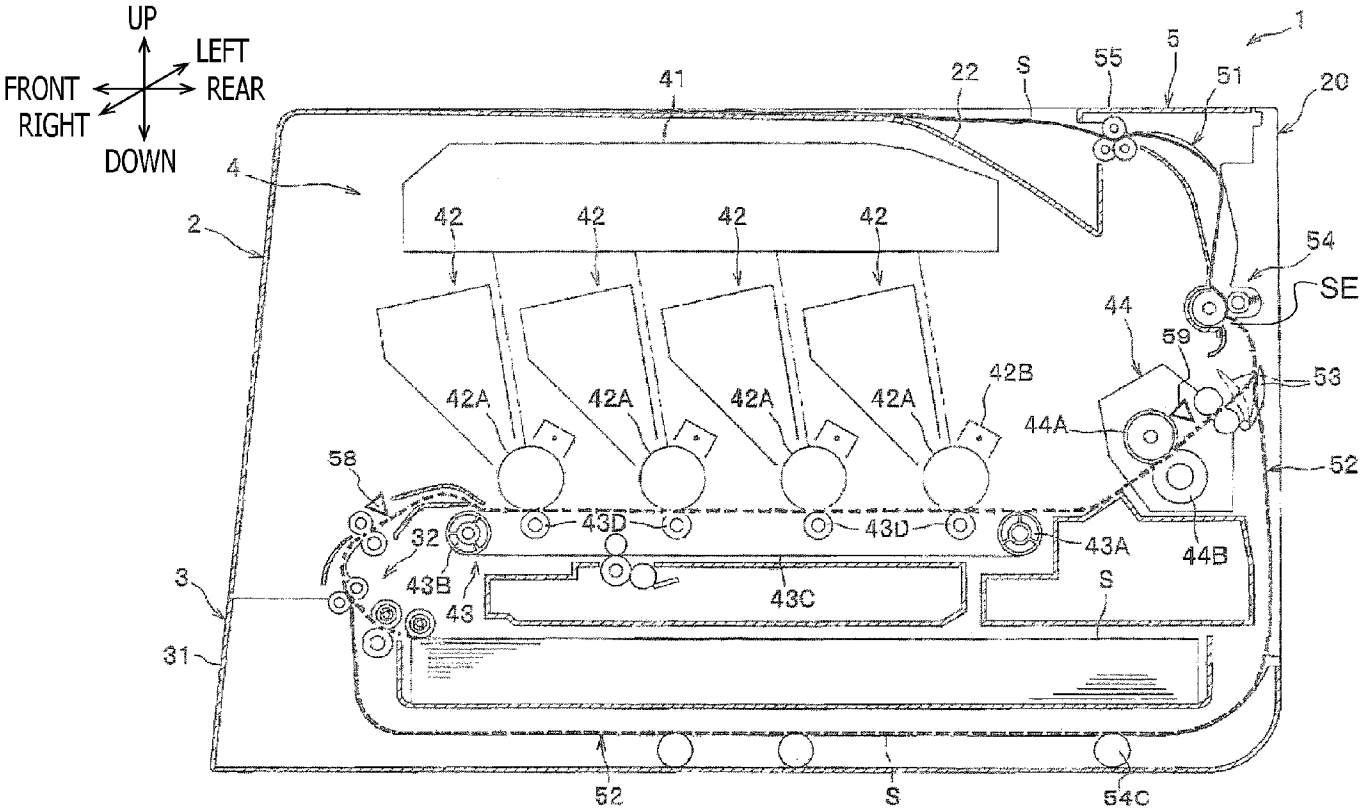
Figure 7:
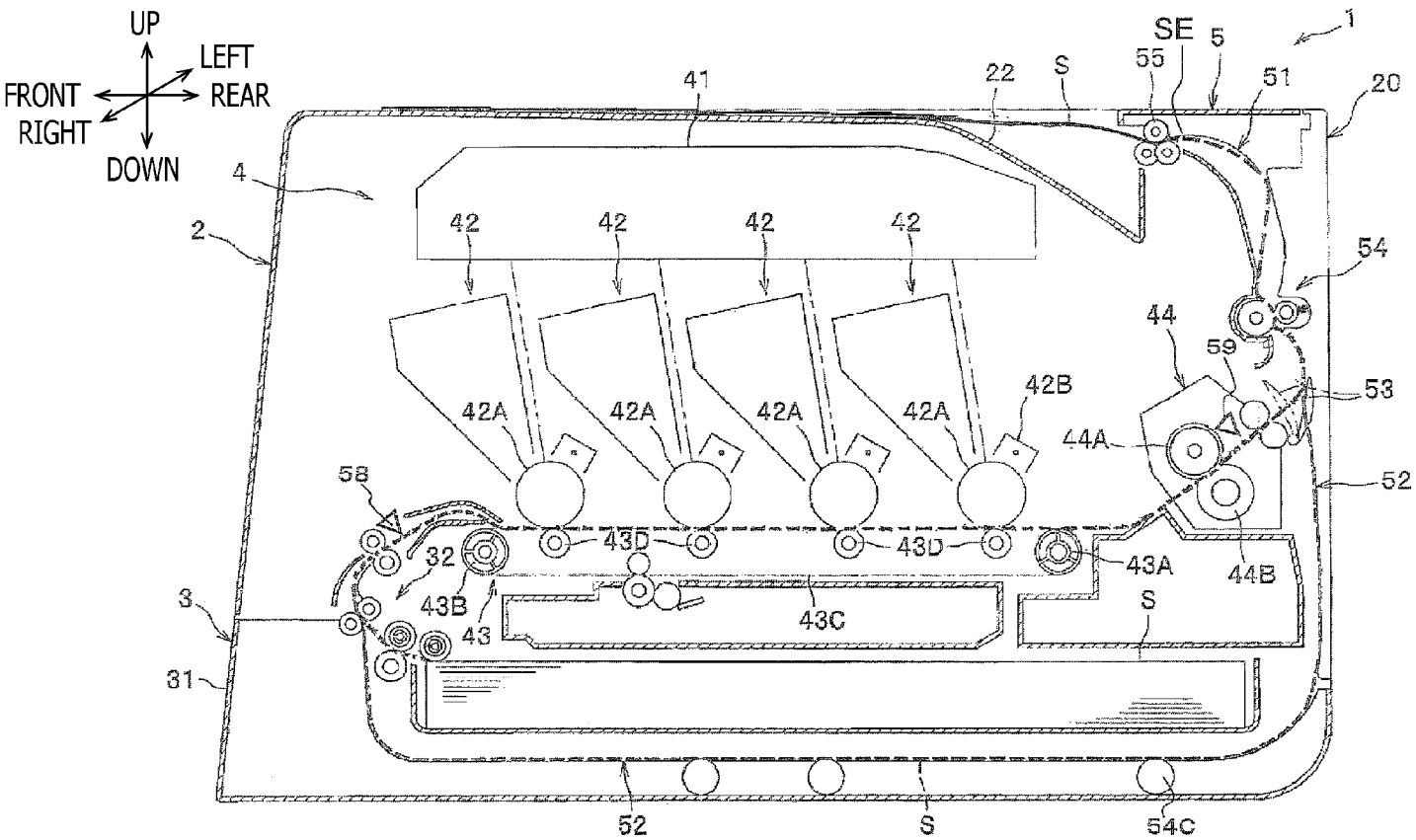
Figure 8:
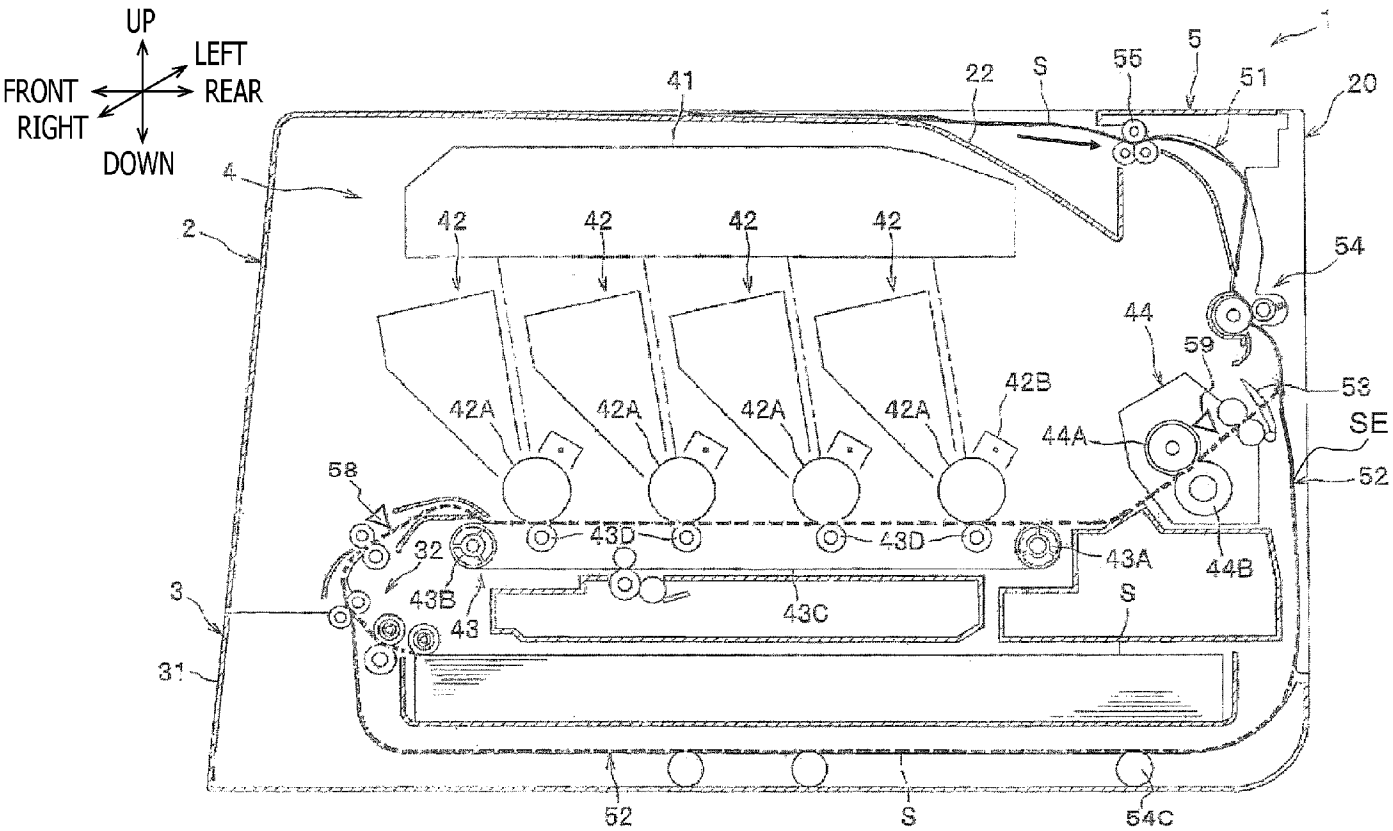

After thermally fixed by the fixing unit 44, the sheet S is conveyed as sequentially shown in FIGS. 6 and 7 in the aforementioned order, such that the trailing end of the sheet S passes through the cooling rollers 54. Namely, in the first mode, the whole sheet S with the image formed only on the first side is cooled by the cooling roller 54. After that, as illustrated in FIG. 7, the sheet S is conveyed to a position where a trailing-end side of the sheet S, which is a side closer to the trailing end SE in the sheet feeding direction, is nipped by the ejections rollers 55 and the sheet S is not completely ejected from the ejection rollers 55.

The predetermined time S1 set in S102 has previously been determined based on the time when the sheet sensor 59 detects the trailing end SE of the sheet S as a time when the ejection rollers 55 will likely nip a portion of the sheet S near the trailing end SE, and recorded on the ROM 82. Referring to the predetermined time S1 set on the RAM 83, the CPU 81 determines whether the predetermined time S1 has elapsed. When determining that the predetermined time S1 has elapsed (S103: Yes), the CPU 81 instructs the stepping motor controller 87 to reversely rotate the stepping motor M2 that has been rotating normally until then, such that the sheet S is switched back with the cooling rollers 54 and the ejection rollers 55 reversely rotated (S104). Thereafter, the CPU 81 goes back to the main routine (not shown).

By the switchback, the sheet S, which is nipped by the ejection rollers 55 and partially exposed to above the catch tray 22 outside the main body casing 2, is again drawn into the main body casing 2.

The sheet S switched back is conveyed from the ejection rollers 55 toward the cooling rollers 54 on the feeding path 51, and further fed down toward the reverse path 52 by the cooling rollers 54 reversely rotating. It is noted that since the sheet feeding direction is reversed due to the reverse rotations of the ejection rollers 55 and the cooling roller 54, the sheet S is reversely conveyed with the leading end and the trailing end switched to each other. After that, the sheet S is again conveyed to the image forming unit 4 such that an image is formed on the second side thereof. Then, the sheet S is ejected onto the catch tray 22 by the cooling rollers 54 and the ejection rollers 55 that have been switched to normally rotate at a predetermined moment.

In the first mode where the sheet S has to be cooled and the in-device temperature is higher, the sheet S is certainly cooled as wholly passing through the cooling rollers 54 without concern about the "loss of synchronism." Further, since the sheet S is ejected by the ejection rollers 55 to be mostly exposed to above the catch tray 22, the sheet S is cooled naturally outside the main body casing 2. Therefore, it is possible to cool the sheet S more promptly even when the in-device temperature is higher.

(2) Second Mode (Double-Side Printing and the Temperature T≤T1)

Figure 5:
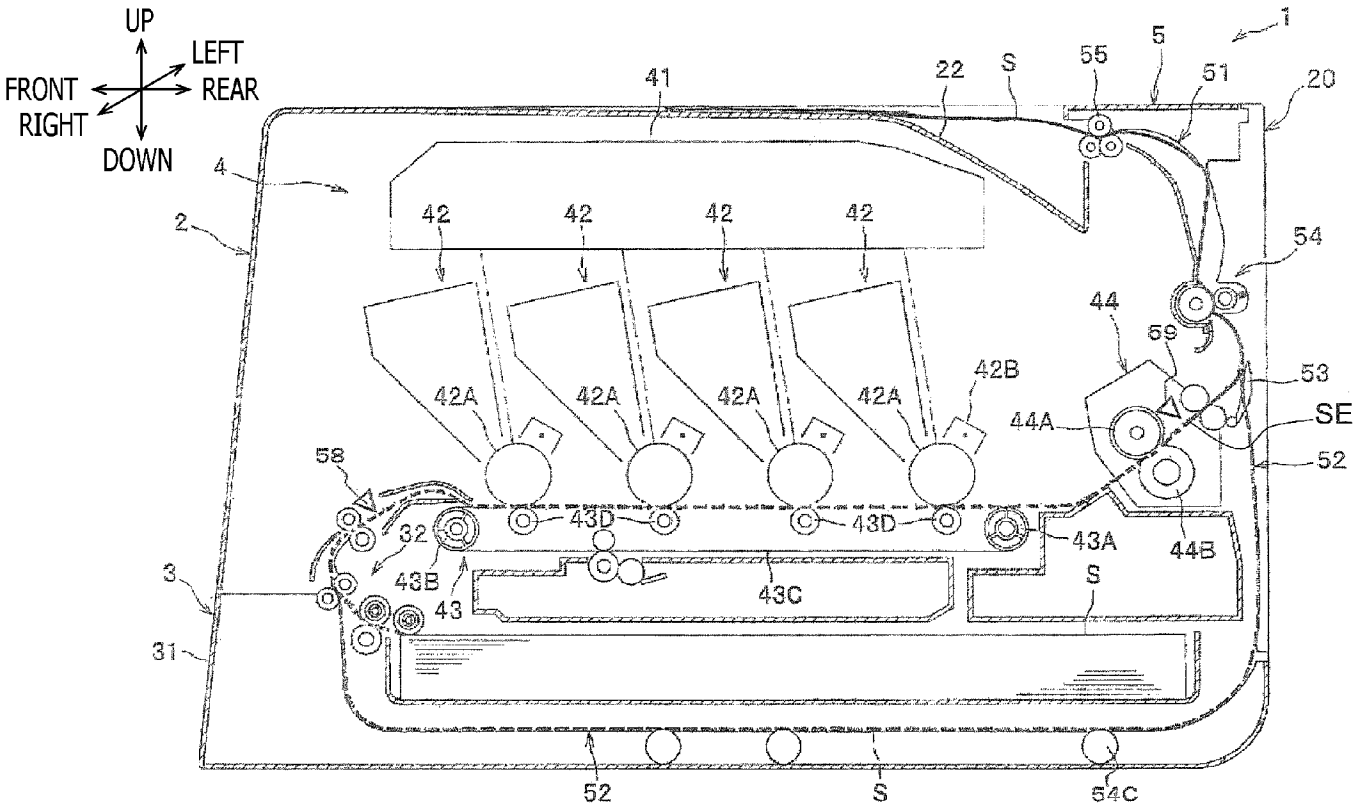
FIGS. 5 to 8 show various locations of (a trailing end) of a sheet being conveyed in the color printer in the embodiment according to one or more aspects of the present invention.

In the flowchart shown in FIG. 4, when determining that the in-device temperature T is equal to or lower than the temperature T1 (S100: No), the CPU 81 waits in a standby state for the trailing end SE of the sheet S to pass through the sheet sensor 59 as shown in FIG. 5 (S105: No). When determining that the trailing end SE of the sheet S has passed through the sheet sensor 59 based on the detection result of the sheet sensor 59 (S105: Yes), the CPU 81 sets, onto the RAM 83, a predetermined time S2 stored on the ROM 82 (S106). Further, the CPU 81 sets the built-in timer and controls the stepping motor M2 to keep rotating normally until the predetermined time S2 set on the RAM 83 elapses (5107: No).

After thermally fixed by the fixing unit 44, the sheet S is conveyed to a position as shown in FIG. 6, where a portion of the sheet S near the trailing end SE is nipped by the cooling rollers 54.

The predetermined time S2 set in S105 has previously been determined based on the time when the sheet sensor 59 detects the trailing end SE of the sheet S as a time when the cooling rollers 54 will likely nip a portion of the sheet S near the trailing end SE, and recorded on the ROM 82. Referring to the predetermined time S2 set on the RAM 83, the CPU 81 determines whether the predetermined time S2 has elapsed. When determining that the predetermined time S2 has elapsed (S107: Yes), the CPU 81 instructs the stepping motor controller 87 to reversely rotate the stepping motor M2 such that the sheet S is switched back with the cooling rollers 54 and the ejection rollers 55 reversely rotated (S104). Thereafter, the CPU 81 goes back to the main routine (not shown).

By the switchback, the sheet S is again drawn into the main body casing 2 while being nipped by the cooling rollers 54.

Thus, since the operation of switching back the sheet S is started with the sheet S being nipped by the cooling rollers 54, there is no change (rise) of the required driving torque of the stepping motor M2 caused at a moment when the sheet S is nipped by the cooling rollers 54 even in the second mode where the in-device temperature T is relatively higher in comparison with the first mode. Therefore, it is possible to prevent shortage of torque of the stepping motor M2 and the "loss of synchronism." Here, preferably, the moment when the sheet S is to be switched back in the second mode may be set to a moment when the cooling rollers 54 nips a portion of the sheet S which portion is close to the trailing end SE (in the sheet feeding direction) and outside the printable area. Thereby, it is possible to evenly cool the sheet S at least within the printable area. Further, in the second mode where the in-device temperature T is lower than in the first mode, the sheet S is less required to be wholly cooled. Therefore, it is possible to omit needless feeding and needless cooling of the sheet S.

The sheet S switched back is conveyed down toward the reverse path 52 by the cooling rollers 54 reversely rotating, in the same manner as the first mode.

In the second mode, the in-device temperature T (inside the color printer 1) is lower than in the first mode. Therefore, there is more concern that the stepping motor M2 might cause the "loss of synchronism." Nonetheless, in the second mode, since the sheet S being nipped by the cooling rollers 54 is switched back, there is no concern about shortage of torque of the stepping motor M2 caused at a moment when the sheet S is inserted between the cooling rollers 54. Thus, it is possible to prevent the "loss of synchronism" of the stepping motor M2.

Hereinabove, the embodiment according to aspects of the present invention has been described. The present invention can be practiced by employing conventional materials, methodology and equipment. Accordingly, the details of such materials, equipment and methodology are not set forth herein in detail. In the previous descriptions, numerous specific details are set forth, such as specific materials, structures, chemicals, processes, etc., in order to provide a thorough understanding of the present invention. However, it should be recognized that the present invention can be practiced without reapportioning to the details specifically set forth. In other instances, well known processing structures have not been described in detail, in order not to unnecessarily obscure the present invention.

Only an exemplary embodiment of the present invention and but a few examples of their versatility are shown and described in the present disclosure. It is to be understood that the present invention is capable of use in various other combinations and environments and is capable of changes or modifications within the scope of the inventive concept as expressed herein. For example, the following modifications are possible.

[Modifications]

In the aforementioned embodiment, the stepping motor M2 is employed. However, instead of the stepping motor M2, a generally used DC motor may be employed.

Further, in the aforementioned embodiment, by reversely rotating the stepping motor M2, the cooling rollers 54 and the ejection rollers 55 are reversely rotated. However, the cooling rollers 54 and the ejection rollers 55 may be reversely rotated by a gear mechanism configured with a solenoid that switches between normal rotation and reverse rotation of the cooling rollers 54 and the ejection rollers 55 while keeping the stepping motor M2 rotating in a single direction.

The cooling rollers 54 may be replaced with a different member formed in a shape other than rollers, such as a belt. Further, in the aforementioned embodiment, the cooling rollers 54 are configured as a pair of rollers. However, instead of the cooling rollers 54, a different mechanism configured to feed the sheet S while nipping the sheet S may be applied to the present invention, such as a mechanism configured with a sheet guide plate fixed to face the driving roller 54A.

<Operations and Effects>

According to the color printer 1 configured as above, since the mode is switched between the first mode and the second mode depending on the in-device temperature T of the color printer 1. Thus, it is possible to perform sheet feeding depending on a situation. Especially, in the second mode where the in-device temperature T of the color printer 1 is lower than in the first mode, the stepping motor M2 might cause the "loss of synchronism" while the sheet S being nipped by the cooling rollers 54 is switched back. Therefore, it is possible to prevent shortage of torque of the stepping motor M2 that may be caused at a moment when the sheet S is inserted between the cooling rollers 54 and prevent the "loss of synchronism." Further, in the second mode where the in-device temperature T is lower than in the first mode, the sheet S is less required to be wholly cooled. Therefore, it is possible to omit needless feeding and needless cooling of the sheet S.

In order to detect a moment when the stepping motor M2 is to be reversely rotated, one or more sheet sensors may be placed in a position where the sheet S is to be switched back. Nonetheless, the moment when the stepping motor M2 is to be reversely rotated may be set based on elapsed times determined from the detection result of the single sheet sensor 59 to differ depending on the modes. In this case, it is possible to reduce the number of sensors and a manufacturing cost of the color printer 1.

In the second mode, the moment when the cooling rollers 54 are to be reversely rotated may be a moment when the cooling rollers 54 at least nip the sheet S. Nevertheless, especially, when the cooling rollers 54 are reversely rotated at a moment to nip a portion of the sheet S which portion is close to the trailing end SE and outside the printable area, it is possible to evenly cool the sheet S at least within the printable area. Thus, it is preferable that at least the printable area of the sheet S can be prevented from unevenly drying.

Further, the cooling rollers 54 may be configured with a plurality of rollers, each of which rollers is narrower than the printable area of the sheet S in a sheet width direction (i.e., the left-to-right direction) perpendicular to the sheet feeding direction, arranged along the sheet feeding direction so as to contact the whole printable area of the sheet S. Nevertheless, more preferably, the cooling rollers 54 may be configured with a pair of rollers each of which rollers is wider than the printable area of the sheet S (further preferably, than the width of the sheet S) in the sheet width direction (the left-to-right direction) perpendicular to the sheet feeding direction. In this case, it is possible to cool the printable area or the whole area of the sheet S with the pair of rollers (with only a single roller placed along the sheet feeding direction). Thus, such a configuration is more preferable in terms of downsizing of the color printer 1.

The reverse path 52, on which the sheet S switched back by the cooling rollers 54 is guided, diverges from the middle of the feeding path 51 guiding the sheet S from the fixing unit 44 to the cooling roller 54. Therefore, when the sheet S being nipped by the cooling rollers 54 is switched back, the sheet S can be guided to the reverse path 52.

The cooling rollers and the ejection rollers 55 may be driven by a DC motor. However, in terms of reversely rotating control, it is more preferable that the cooling rollers and the ejection rollers 55 are driven by the stepping motor M2.

What is claimed is:

1. An image forming apparatus configured to print an image on each side of a sheet by switching back the sheet, comprising:

an image forming unit configured to form a developer image on the sheet;

a fixing unit configured to fix the developer image formed on the sheet by the image forming unit;

a cooling roller disposed downstream relative to the fixing unit in a sheet feeding direction along a main sheet conveyance path, the cooling roller being configured to contact the sheet conveyed along the main sheet conveyance path and to cool the sheet on which the developer image is fixed by the fixing unit;

an ejection roller disposed downstream relative to the cooling roller in the sheet feeding direction along the main sheet conveyance path, the ejection roller being configured to eject the sheet onto a catch tray;

a driving unit configured to rotate the cooling roller and the ejection roller normally or reversely;

a temperature sensor configured to detect a temperature of the image forming apparatus; and a controller comprising a determining unit configured to make a determination as to whether the temperature detected by the temperature sensor is higher than a predetermined temperature, the controller being configured to switch a control mode between a first mode and a second mode based on the determination made by the determining unit as to whether the detected temperature is higher than the predetermined temperature, wherein, in the first mode, after a trailing end of the sheet has passed the cooling roller, the controller controls the driving unit to reversely rotate the cooling roller and the ejection roller being rotated normally, wherein in the second mode, in a state where the cooling roller is nipping the sheet, the controller controls the driving unit to reversely rotate the cooling roller and the ejection roller being rotated normally, wherein, when the cooling roller and the ejection roller rotate reversely, the cooling roller and ejection roller rotate in a first direction and are configured to convey the sheet toward a sheet re-conveyance path, and wherein, when the cooling roller and the ejection roller rotate normally, the cooling roller and ejection roller rotate in a second direction opposite to the first direction and are configured to convey the sheet toward the catch tray.

2. The image forming apparatus according to claim 1, further comprising:

a sheet sensor configured to detect the sheet conveyed to a position downstream relative to the fixing unit in the sheet feeding direction; and a timing setting unit configured to set a time at which the driving unit is to reversely rotate the cooling roller and the ejection roller being rotated normally in each of the first and second modes, based on a detection result of the sheet sensor.

3. The image forming apparatus according to claim 1, wherein the controller switches the control mode to the first mode when determining that the temperature detected by the temperature sensor is higher than the predetermined temperature.

4. The image forming apparatus according to claim 1, wherein, when switching the control mode to the second mode, the controller controls the driving unit to reversely rotate the cooling roller and the ejection roller being rotated normally, in a state where the cooling roller is nipping a portion of the sheet close to a trailing end of the sheet in the sheet feeding direction and outside of a printable area.

5. The image forming apparatus according to claim 1, wherein the cooling roller is wider than a printable area of the sheet in a sheet width direction perpendicular to the sheet feeding direction.

6. The image forming apparatus according to claim 5, wherein the cooling roller is wider than the sheet in the sheet width direction perpendicular to the sheet feeding direction.

7. The image forming apparatus according to claim 1, wherein:

the image forming apparatus is configured to guide the sheet from the fixing unit to the cooling roller along the main sheet conveyance path; and the image forming apparatus is configured to guide, to the image forming unit and along the re-conveyance path, the sheet switched back by the cooling roller in response to the driving unit reversely rotating the cooling roller, the re-conveyance path diverging from a middle of the main sheet conveyance path from the fixing unit to the cooling roller.

8. The image forming apparatus according to claim 1, wherein the driving unit comprises a stepping motor.

9. A control method for controlling an image forming apparatus configured to print an image on each side of a sheet by switching back the sheet, the method comprising:

detecting a temperature of the image forming apparatus;

determining whether the detected temperature is higher than a predetermined temperature; and switching a control mode between a first mode and a second mode based on the determination as to whether the detected temperature is higher than the predetermined temperature, wherein in the first mode, after a trailing end of the sheet has passed through a cooling roller, the cooling roller and an ejection roller being rotated normally are controlled to reversely rotate, wherein the cooling roller is disposed downstream relative to a fixing unit of the image forming apparatus in a sheet feeding direction along a main sheet conveyance path, the cooling roller being configured to contact the sheet conveyed along the main sheet conveyance path and to cool the sheet on which the developer image is fixed by the fixing unit, and wherein in the second mode, in a state where the cooling roller is nipping the sheet, the cooling roller and the ejection roller being rotated normally are controlled to reversely rotate, wherein the ejection roller is disposed downstream relative to the cooling roller in the sheet feeding direction along the main sheet conveyance path, the ejection roller being configured to eject the sheet onto a catch tray, wherein, when the cooling roller and the ejection roller rotate reversely, the cooling roller and ejection roller rotate in a first direction and are configured to convey the sheet toward a sheet re-conveyance path, and wherein, when the cooling roller and the ejection roller rotate normally, the cooling roller and ejection roller rotate in a second direction opposite to the first direction and are configured to convey the sheet toward the catch tray.

10. The control method according to claim 9, further comprising:

detecting that the sheet has been conveyed to a position downstream relative to the fixing unit in the sheet feeding direction; and setting a time at which the cooling roller and the ejection roller being rotated normally are to be reversely rotated in each of the first and second modes, based on a result of detecting that the sheet has been conveyed to a position downstream relative to the fixing unit.

11. The control method according to claim 9, wherein the control mode is switched to the first mode when it is determined that the detected temperature is higher than the predetermined temperature.

12. The control method according to claim 9, wherein, when the control mode is switched to the second mode, the cooling roller and the ejection roller being rotated normally are controlled to reversely rotate, in a state where the cooling roller is nipping a portion of the sheet close to a trailing end of the sheet in the sheet feeding direction and outside of a printable area.

13. The control method according to claim 9, wherein the cooling roller is wider than a printable area of the sheet in a sheet width direction perpendicular to the sheet feeding direction.

14. The control method according to claim 13, wherein the cooling roller is wider than the sheet in the sheet width direction perpendicular to the sheet feeding direction.

15. The control method according to claim 9, wherein the image forming apparatus further comprises:

a feeding path configured to guide the sheet from the fixing unit to the cooling roller; and a reverse path configured to guide, to an image forming unit, the sheet switched back by the cooling roller in response to the cooling roller being controlled to reversely rotate, the reverse path diverging from a middle of the feeding path from the fixing unit to the cooling roller.

16. The control method according to claim 9, wherein switching the control mode includes rotating the cooling roller and the ejection roller normally or reversely by operating a stepping motor.

* * * * *